United States Patent [19]

Deuring

[11] Patent Number: 4,656,978

[45] Date of Patent: Apr. 14, 1987

[54] VALVE CLEARANCE ADJUSTING DEVICE

[75] Inventor: Hans Deuring, Burscheid, Fed. Rep. of Germany

[73] Assignee: Goetze AG, Burscheid, Fed. Rep. of Germany

[21] Appl. No.: 847,229

[22] Filed: Apr. 2, 1986

[30] Foreign Application Priority Data

Apr. 12, 1985 [DE] Fed. Rep. of Germany ..... 3513161

[51] Int. Cl.[4] ..... F01L 1/24

[52] U.S. Cl. ..... 123/90.55; 123/90.58

[58] Field of Search ..... 123/90.55, 90.58, 90.46

[56] References Cited

U.S. PATENT DOCUMENTS

| | | | |
|---|---|---|---|
| 2,833,257 | 5/1958 | Lengnick | 123/90.58 |
| 4,191,142 | 3/1980 | Kodama | 123/90.55 |
| 4,397,271 | 8/1983 | Gardner | 123/90.58 |
| 4,590,899 | 5/1986 | Kowal et al. | 123/90.55 |

FOREIGN PATENT DOCUMENTS

| | | | |
|---|---|---|---|
| 2517370 | 10/1976 | Fed. Rep. of Germany . | |
| 2089923 | 6/1982 | United Kingdom | 123/90.55 |

*Primary Examiner*—Ira S. Lazarus

*Attorney, Agent, or Firm*—Spencer & Frank

[57] ABSTRACT

An engine valve actuating mechanism includes a hollow reciprocating tappet, a tappet bottom arranged for engagement with a rotary cam of an engine cam shaft, a valve clearance adjusting device accommodated in the tappet and inlcuding a valve clearance adjusting element cooperating with the valve stem of the engine valve, a chamber within the tappet, filled with a hydraulic fluid, and an elastic diaphragm supported in the tappet and arranged for bounding and sealing the chamber. The diaphragm extends generally radially relative to the tappet axis between an inner circumferential wall surface of the tappet and the valve clearance adjusting element. The diaphragm has radially inner and radially outer circumferential zones. There are further provided first and second reinforcing elements supported in the tappet. The first reinfocing element is arranged for radially pressing the radially outer diaphragm zone against the inner tappet surface and the second reinforcing element is arranged for radially pressing the radially inner diaphram zone against the valve clearance adjusting element.

22 Claims, 4 Drawing Figures

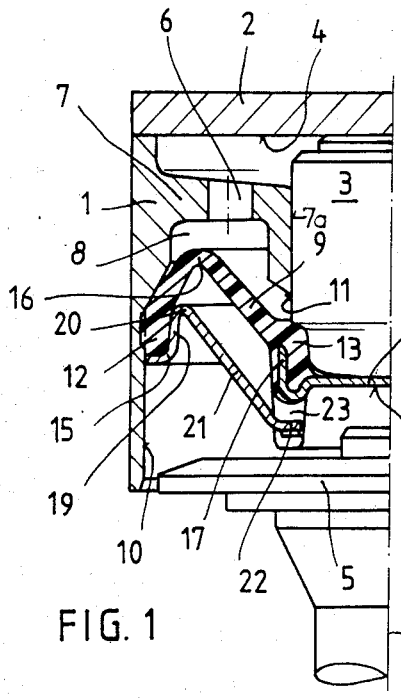
FIG. 1
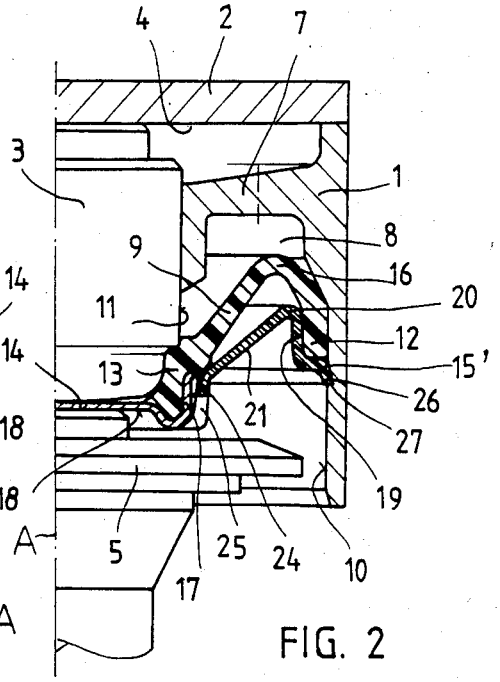
FIG. 2
FIG. 3
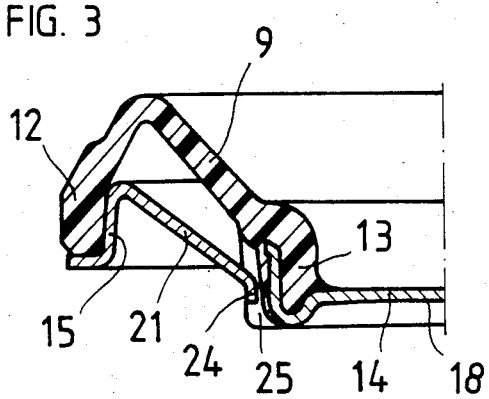
FIG. 4
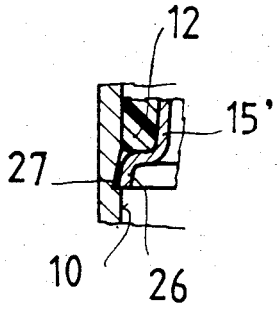

VALVE CLEARANCE ADJUSTING DEVICE

BACKGROUND OF THE INVENTION

This invention relates to a valve clearance adjusting device, particularly for valves used in internal combustion engines. The device includes a valve tappet (valve lifter) arranged preferably in the vicinity of the engine cam shaft to be reciprocated by a cam thereof, a valve clearance adjusting element arranged within the tappet and cooperating with the valve stem as well as an elastic diaphragm sealing a chamber which is situated within the valve tappet and which is filled with an incompressible fluid.

German Offenlegungsschrift (Non-examined Published Patent Application) No. 2,517,370 discloses a hydraulic valve clearance adjusting device, particularly for controlling the valves of internal combustion engines. A cross-sectionally approximately U-shaped valve tappet cooperates with the cam shaft and an axially displaceable piston which is received in the tappet and which bounds a pressure chamber defined within the tappet. Within the pressure chamber there are arranged a plurality of individual components, together forming the valve clearance adjusting element. The pressure chamber which is entirely filled with a hydraulic fluid is sealed by means of a substantially hose-shaped elastic diaphragm.

The individual components forming the valve clearance adjusting element have to be separately installed during the assembly of the valve clearance adjusting device. Such systems are not adapted for new, closed-system, tappet assemblies which are presently under development. Since in the new systems to be developed, various structural variants are considered, the diaphragms can also not be used as sealing elements in their earlier-noted conventional configuration.

SUMMARY OF THE INVENTION

It is an object of the invention to provide an improved arrangement for sealing closed-system valve tappets which provide for valve clearance adjustment in response to wear, as well as temperature increases and volume changes of the hydraulic medium. At the same time, the seal has to be able to transmit valve lifting forces from the tappet to the valve stem.

This object and others to become apparent as the specification progresses, are accomplished by the invention, according to which, briefly stated, the diaphragm extends generally radially between the inner circumferential face of the tappet and the outer circumferential face of the valve clearance adjusting element and is, in its inner and outer radial end zones firmly positioned by clamping action of reinforcing (stiffening) elements. Advantageously, elastomer diaphragms are used which need to be flexible and thus must have thin walls.

In order to enhance the radial clamping effect, that is, in order to achieve a good radial bias in the elastomer material, the radial end zones of the diaphragm are of thickened, bead-like construction. The two bead-like end zones are connected with one another with a diaphragm having a thinner cross section of preferably V-shaped cross-sectional configuration; the ridge of the diaphragm is oriented axially in the direction of the tappet bottom.

The requirements concerning flexibility of the system in a temperature range from between −40° C. to +170° C. presupposes the use of a silicone or fluorosilicone rubber for the elastic part (diaphragm). These materials have a total life span of at least 10 years of service, during which they are exposed to dynamic stresses during an engine run of, for example, 200,000 kilometers.

According to a further feature of the invention, the reinforcing element which clamps the radially inner zone of the diaphragm to the external circumferential zone of the valve clearance adjusting element is constituted by an approximately tubular metal component. In order to ensure that the valve clearance adjusting element, which is a one-piece body, is not only clamped radially but is also secured against an axial fall-out during shipping and assembly of the complete valve clearance adjusting device, the tubular metal component is provided with a bottom which is preferably recessed in the axial direction of the valve clearance adjusting element. This arrangement ensures that the entire zone between the valve and the cam shaft is sealed while there is ensured a superior axial guidance of the valve clearance adjusting element and the valve stem which is stepped in this zone. The transition of the tubular zone in the bottom has an approximately semicircular cross section. The entire body may be made in a simple manner as a deep-drawn component; in the mounting position the open zone of the U-shaped metal component is oriented axially in the direction of the valve clearance adjusting element.

Dependent upon the particular application and the elastomer material to be used, according to a further feature of the invention, the metal component is, at least in its tubular zone, vulcanized to the radially inner bead of the diaphragm. The sealing between the valve clearance adjusting element and the bead-like zone of the diaphragm is effected by clamping rather than by the adhesion properties of the elastomer material at the location of vulcanization.

As noted earlier, the radially inward clamping metal part is of profiled configuration. This arrangement ensures—in addition to the earlier-mentioned advantages—that the individual metal components may be accurately positioned in a vulcanizing mold in order to maintain tolerances to a very low value and to ensure that in the tight space available there will be ensured a relatively large distance between the radially inner and the radially outer reinforcing element. Such an arrangement enhances the flexibility of the elastic diaphragm. The orientation in the vulcanizing mold at the same time results in a positioning of the two reinforcing elements in the hydraulic tappet.

For transmitting the valve lifting force from the tappet to the valve stem with the intermediary of the valve clearance adjusting element, according to a further feature of the invention the stiffening element which radially clamps the diaphragm bead cooperating with the tappet is also of tubular construction. Since in such an arrangement there is no vulcanization between the radially outer bead and the reinforcing element but rather, an immobilization is effected purely by clamping, the stiffening element may be made of metal or an appropriate synthetic material.

In order to adapt the outer stiffening element to the diaphragm contour, that is, to the radially outer bead of the diaphragm, the stiffening element has a downstepped configuration in the zone of its radially outer axial portion. The end zone of the stiffening element terminating in the zone of the V-profile of the diaphragm is provided, according to a further feature of the invention, with a plurality of substantially radially extending resilient tongues which cooperate with the diaphragm. The tongues are preferably not parallel to the inwardly extending zone of the diaphragm. In addition to an axial support of the diaphragm, the tongues also serve to transmit the valve lifting forces. To optimize such a force transmission, according to a further feature of the invention, the tongues are, at their free ends, bent approximately axially in the direction of the valve stem. The bends proper of the tongues are substantially parallel to the tubular zone of the radially inward-located metal component. The bent portions of the tongues extend into cooperating recesses in the zone of the radially inner bead of the diaphragm and thus constitute a lock against rotation.

In the alternative, the radially outer stiffening element may offer the possibility to bend the radially springing tongues in such a manner that they engage radially underneath the tubular zone of the radially inner metal component. This arrangement simultaneously provides for a hold-down of the inner metal component which is held on the head of the valve clearance adjusting element until, subsequent to assembling the valve tappet in the cylinder head of the engine, the valve stem terminus itself presses against the cap-like construction in a form-locking manner.

The above-described arrangement has the advantage that the hold-down component and the diaphragm form a single structural unit which may be handled with ease during the final assembly and eliminates the necessity to hold the valve clearance adjusting element above the diaphragm which is excessively flexible for this purpose. This arrangement also ensures safe shipping.

According to a further feature of the invention, the axial leg of the radially outer stiffening element which cooperates with the valve tappet is bent at an angle in the direction of the valve tappet and projects, upon assembly, into a corresponding groove provided in the inner circumferential zone of the diaphragm.

The element which is used for the transmission of the valve lifting forces may be so constructed that it replaces the vulcanized metal ring for the seat in the tappet. In such case the force-transmitting part is accommodated in a groove provided in a radially outer zone of the diaphragm and thus simultaneously forms a support ring for the clamping connection with the valve tappet.

BRIEF DESCRIPTION OF THE DRAWING

FIG. 1 is an axial sectional view of a preferred embodiment of the invention.

FIG. 2 is an axial sectional view of another preferred embodiment of the invention.

FIG. 3 is an axial sectional view of a detail of FIG. 1, illustrated on an enlarged scale.

FIG. 4 is a modified axial sectional detail of FIG. 3.

DESCRIPTION OF THE PREFERRED EMBODIMENTS

FIGS. 1 and 2 each illustrate a hydraulic valve clearance adjusting device whose basic structures are identical; they differ from one another only in the construction of the sealing zone, as will be described later. The components effecting valve clearance adjustment and the operational principle thereof is conventional and are therefore not discussed in detail.

The valve clearance adjusting device comprises a cross-sectionally generally U-shaped valve tappet 1 whose bottom 2 cooperates with a cam of the engine cam shaft (neither shown). The hollow valve tappet 1 which has a tappet axis A, accommodates a one-piece valve clearance adjusting element 3 which, by itself, is a conventional component and is not illustrated in detail. The valve clearance adjusting element 3 cooperates, at one end, with the inner end face 4 of the tappet bottom 2 and, on the other end, cooperates with a valve stem 5. The valve clearance adjusting element 3 is guided in a central opening *7a* of a tappet web 7 which is provided with axial bores 6 (only one shown) radially adjacent the central opening *7a*.

For sealing a pressure chamber 8 defined within the tappet 1 and filled with an incompressible medium, there is provided an elastic diaphragm 9 which extends generally radially between the inner circumferential face 10 of the valve tappet 1 and the outer circumferential face 11 of the valve clearance adjusting element 3. The diaphragm 9 has a generally V-shaped cross-sectional configuration. In its outer and inner radial circumferential end zones 12 and 13 the diaphragm 9 is thickened in a bead-like manner and is, by means of radial clamping effected by reinforcing or stiffening elements 14, 15 (FIG. 1) and 14, 15' (FIG. 2) immobilized in its desired position. The ridge 16 of the diaphragm 9 is oriented towards the tappet bottom 2. The diaphragm 9 is made preferably of a fluorosilicone rubber. The stiffening element 14 which clamps the radially inner bead 13 of the diaphragm 9 is a deep-drawn metal component having a tubular outer zone 17 coaxial with the tappet axis A. The metal component 14 is provided with an axially recessed body 18 for an axial support of the valve clearance adjusting element 3. The tubular zone 17 of the metal component 14 is bonded preferably by vulcanization with the radially inner bead 13 of the diaphragm 9. The stiffening element 15 (FIG. 1) or 15' (FIG. 2) which immobilizes the radially outer bead 12 radially with respect to the valve tappet 1 is also of tubular configuration arranged coaxially with the tappet axis A. The stiffening element 15 shown in FIG. 1 is of metal while the stiffening element 15' shown in FIG. 2 is of plastic. Both stiffening elements 15, 15' are, in their radially outer zone 19, of a stepped-down configuration, while the diaphragm-side end zone 20 of the stiffening elements 15, 15' continue as generally radially extending tongues 21 arranged in an array about the tappet axis A.

According to FIG. 1, the free end zones 22 of the tongues 21 are radially bent and extend underneath the tubular zone 17 of the inner stiffening element 14. This arrangement serves as a safety retainer during storage and shipping. The tongues extend, for the purpose of transmitting the valve lifting forces, into corresponding recesses 23 of the bead 13.

In the embodiment shown in FIG. 2, the resilient tongues 21' are approximately axially bent in their free end zones 24 approximately parallel to the tubular zone 17 of the inner stiffening element 14 and are, for transmitting the valve lifting forces, received in corresponding openings 25 of the bead 13. The tightening of the radially outer bead 12 to the inner circumferential face 10 of the valve tappet 1 is effected, in the FIG. 1 arrangement, solely by the clamping action of the stiffening element 15. In the FIG. 2 construction, the axial leg 26 of the stiffening element 15' cooperating with the inner circumferential face 10 of the valve tappet 1 is bent approximately radially and during assembly is snapped into a circumferential annular groove 27 of the valve tappet 1.

FIGS. 3 and 4 illustrate the diaphragm 9 in detail. The radially inner stiffening element 14 is vulcanized to the bead 13, while the radially outer stiffening element 15 is formed as a pure clamping component and, on the one hand, clamps the radially outer bead 12 and, on the other hand, extends into corresponding recesses 25 in the bead 13 with bent portions 24 of the resilient tongues 21 for effecting transmission of valve lifting forces. FIG. 4 shows the earlier-noted snap-in connection between the radially bent axial leg 26 of the stiffening element 15' and the annular groove 27 provided in the inner circumferential face of the valve tappet 1.

It will be understood that the above description of the present invention is susceptible to various modifications, changes and adaptations, and the same are intended to be comprehended within the meaning and range of equivalents of the appended claims.

What is claimed is:

1. In a valve actuating mechanism for periodically opening and closing an engine valve, including a hollow reciprocating tappet having a tappet axis, a tappet bottom having an outer face arranged for engagement with a rotary cam of an engine cam shaft, and an inner circumferential wall surface; a valve clearance adjusting device accommodated in the tappet and including a valve clearance adjusting element having an outer circumferential face and cooperating with a valve stem of said engine valve, a chamber defined in said tappet, said chamber being filled with a hydraulic fluid, and an elastic diaphragm supported in said tappet and arranged for bounding and sealing said chamber; the improvement wherein said diaphragm extends generally radially relative to said tappet axis between said inner circumferential wall surface of said tappet and said outer circumferential face of said valve clearance adjusting element; said diaphragm having a radially inner circumferential zone adjacent said outer circumferential face of said valve clearance adjusting element and a radially outer circumferential zone adjacent said inner circumferential wall surface of said tappet; the improvement further comprising first and second reinforcing elements supported in said tappet; said first reinforcing element being arranged for radially pressing said radially outer circumferential zone of said diaphragm against said inner circumferential wall surface of said tappet and said second reinforcing element being arranged for radially pressing said radially inner circumferential zone of said diaphragm against said outer circumferential face of said valve clearance adjusting element, whereby said diaphragm is immobilized in a desired orientation.

2. A valve actuating mechanism as defined in claim 1, wherein said diaphragm is a flexible, temperature-resistant silicone rubber.

3. A valve actuating mechanism as defined in claim 1, wherein said diaphragm is a flexible, temperature-resistant fluorosilicone rubber.

4. A valve actuating mechanism as defined in claim 1, wherein said second reinforcing element has a radially outer terminal portion bent at an angle towards said inner circumferential wall surface of said tappet and being in engagement therewith.

5. A valve actuating mechanism as defined in claim 4, wherein said radially outer circumferential zone of said diaphragm has a plurality of circumferentially distributed grooves; and further wherein said radially outer terminal portion of said second reinforcing element is received in a respective said groove by a snap-in engagement.

6. A valve actuating mechanism as defined in claim 1, wherein said radially inner and outer circumferential zones of said diaphragm have a bead-like circumferential enlargement.

7. A valve actuating mechanism as defined in claim 6, wherein said diaphragm has a cross-sectionally V-shaped portion connecting the bead-like enlargements with one another, said V-shaped portion being thinner in cross section than said bead-like enlargements.

8. A valve actuating mechanism as defined in claim 7, wherein said diaphragm has a circumferential ridge formed at a location where said cross-sectionally V-shaped portion joins said radially outer circumferential zone of said diaphragm; said ridge being oriented towards said tappet bottom.

9. A valve actuating mechanism as defined in claim 1, wherein said second reinforcing element comprises a tubular metal part generally coaxial with said tappet axis.

10. A valve actuating mechanism as defined in claim 9, wherein said second reinforcing element has a radial bottom supporting said diaphragm and being interposed between said valve clearance adjusting element and said valve stem.

11. A valve actuating mechanism as defined in claim 10, wherein said second reinforcing element is vulcanized to said radially inner circumferential zone of said diaphragm.

12. A valve actuating mechanism as defined in claim 10, wherein said second reinforcing element has a generally U-shape as viewed in cross section; said radial bottom being axially recessed towards said valve clearance adjusting element.

13. A valve actuating mechanism as defined in claim 12, wherein said second reinforcing element has a transitional portion connecting said radial bottom with said tubular metal part; said transitional portion being generally semicircular, as viewed in cross section.

14. A valve actuating mechanism as defined in claim 12, wherein said U-shape has an open end oriented axially towards said valve clearance adjusting element.

15. A valve actuating mechanism as defined in claim 1, wherein said first reinforcing element comprises a tubular part generally coaxial with said tappet axis.

16. A valve actuating mechanism as defined in claim 15, wherein said first reinforcing element is metal.

17. A valve actuating mechanism as defined in claim 15, wherein said first reinforcing element is a plastic.

18. A valve actuating mechanism as defined in claim 15, wherein said first reinforcing element has a stepped radially outer circumferential zone.

19. A valve actuating mechanism as defined in claim 15, wherein said first reinforcing element has a plurality of generally radially extending resilient tongues arranged in a circular array about said tappet axis; said tongues being generally adjacent a diaphragm portion interconnecting said radially inner and outer circumferential zones with one another; each said tongue having a radially inner free end being in engagement with said radially inner circumferential zone of said diaphragm.

20. A valve actuating mechanism as defined in claim 19, further comprising a plurality of recesses provided in said radially inner circumferential zone of said diaphragm; said free ends of said tongues projecting in said recesses.

21. A valve actuating mechanism as defined in claim 19, wherein said tongues are oriented at an oblique angle to the diaphragm portion interconnecting said radially inner and outer circumferential zones with one another.

22. A valve actuating mechanism as defined in claim 19, wherein said radially inner free end of each said tongue is bent in a direction toward said valve stem; each said free end extending approximately parallel to said tubular part of said first reinforcing element.

* * * * *